US006466117B2

(12) United States Patent
Castonguay et al.

(10) Patent No.: US 6,466,117 B2
(45) Date of Patent: Oct. 15, 2002

(54) CIRCUIT INTERRUPTER OPERATING MECHANISM

(75) Inventors: Roger N. Castonguay, Terryville, CT (US); Dave S. Christensen, Burlington, CT (US); Randy Greenberg, Granby, CT (US); Girish Hassan, Plainville, CT (US); Dean A. Robarge, Southington, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,568

(22) Filed: Sep. 20, 2001

(65) Prior Publication Data

US 2002/0030570 A1 Mar. 14, 2002

Related U.S. Application Data

(62) Division of application No. 09/516,475, filed on Mar. 1, 2000.

(51) Int. Cl.[7] ..... H01H 9/00
(52) U.S. Cl. ..... 335/172; 335/167
(58) Field of Search ..... 335/23–25, 35, 335/167–176

(56) References Cited

U.S. PATENT DOCUMENTS

| | | | |
|---|---|---|---|
| 2,340,682 | A | 2/1944 | Powell |
| 2,719,203 | A | 9/1955 | Gelzheiser et al. |
| 2,937,254 | A | 5/1960 | Ericson |
| 3,105,048 | A | 9/1963 | Bobrowsky |
| 3,155,802 | A | 11/1964 | Wortmann |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,517,356 | A | 6/1970 | Hanafusa |
| 3,624,329 | A | 11/1971 | Fischer |
| 3,631,369 | A | 12/1971 | Menocal |
| 3,803,455 | A | 4/1974 | Willard |
| 3,883,781 | A | 5/1975 | Cotton |
| 4,129,762 | A | 12/1978 | Bruchet |
| 4,144,513 | A | 3/1979 | Shafer et al. |
| 4,158,119 | A | 6/1979 | Krakik |
| 4,165,453 | A | 8/1979 | Hennermann |
| 4,166,988 | A | 9/1979 | Ciarcia et al. |

(List continued on next page.)

FOREIGN PATENT DOCUMENTS

| | | |
|---|---|---|
| BE | 819 008 A | 12/1974 |
| BE | 897 691 A | 12/1974 |
| DE | 12 27 978 | 11/1966 |

(List continued on next page.)

*Primary Examiner*—Lincoln Donovan
(74) *Attorney, Agent, or Firm*—Cantor Colburn LLP

(57) ABSTRACT

An operating mechanism controls and trips a separable contact structure arranged in a protected circuit. The mechanism includes a frame, a drive member pivotally coupled to the frame, a spring pivotally connecting the drive member to a drive connector, an upper link pivotally seated on the drive connector, a lower link member pivotally coupled to the drive connector, a crank member pivotally coupled to the lower link member for interfacing the separable contact structure, and a cradle member pivotally secured to the frame and pivotally securing the upper link. The cradle member is configured for being releasably engaged by a latch assembly, which is displaced upon occurrence of a predetermined condition in the circuit such as a trip condition. The mechanism is movable between a tripped position, a reset position, an off position, and an on position. Spacers are operatively positioned between movable members, and protrusions are operatively formed on the enclosure of the contact structure. The spacers and protrusions serve to widen the stances of the operating mechanism for force distribution purposes, and also to minimize friction between movable components.

37 Claims, 15 Drawing Sheets

U.S. PATENT DOCUMENTS 4,220,934 A 9/1980 Wafer et al.
4,255,732 A 3/1981 Wafer et al.
4,259,651 A 3/1981 Yamat
4,263,492 A 4/1981 Maier et al.
4,276,527 A 6/1981 Gerbert-Gaillard et al.
4,297,663 A 10/1981 Seymour et al.
4,301,342 A 11/1981 Castonguay et al.
4,360,852 A 11/1982 Gilmore
4,368,444 A 1/1983 Preuss et al.
4,375,021 A 2/1983 Pardini et al.
4,375,022 A 2/1983 Daussin et al.
4,376,270 A 3/1983 Staffen
4,383,146 A 5/1983 Bur
4,392,036 A 7/1983 Troebel et al.
4,393,283 A 7/1983 Masuda
4,401,872 A 8/1983 Boichot-Castagne et al.
4,409,573 A 10/1983 DiMarco et al.
4,435,690 A 3/1984 Link et al.
4,467,297 A 8/1984 Boichot-Castagne et al.
4,468,645 A 8/1984 Gerbert-Gaillard et al.
4,470,027 A 9/1984 Link et al.
4,479,143 A 10/1984 Watanabe et al.
4,488,133 A 12/1984 McClellan et al.
4,492,941 A 1/1985 Nagel
4,541,032 A 9/1985 Schwab
4,546,224 A 10/1985 Mostosi
4,550,360 A 10/1985 Dougherty
4,562,419 A 12/1985 Preuss et al.
4,589,052 A 5/1986 Dougherty
4,595,812 A 6/1986 Tamaru et al.
4,611,187 A 9/1986 Banfi
4,612,430 A 9/1986 Sloan et al.
4,616,198 A 10/1986 Pardini
4,622,444 A 11/1986 Kandatsu et al.
4,631,625 A 12/1986 Alexander et al.
4,642,431 A 2/1987 Tedesco et al.
4,644,438 A 2/1987 Puccinelli et al.
4,649,247 A 3/1987 Preuss et al.
4,658,322 A 4/1987 Rivera
4,672,501 A 6/1987 Bilac et al.
4,675,481 A 6/1987 Markowski et al.
4,679,016 A * 7/1987 Ciarcia et al. ..... 335/132
4,682,264 A 7/1987 Demeyer
4,689,712 A 8/1987 Demeyer
4,694,373 A 9/1987 Demeyer
4,710,845 A 12/1987 Demeyer
4,717,985 A 1/1988 Demeyer
4,733,211 A 3/1988 Castonguay et al.
4,733,321 A 3/1988 Lindeperg
4,764,650 A 8/1988 Bur et al.
4,768,007 A 8/1988 Mertz et al.
4,780,786 A 10/1988 Weynachier et al.
4,831,221 A 5/1989 Yu et al.
4,870,531 A 9/1989 Danek
4,883,931 A 11/1989 Batteux et al.
4,884,047 A 11/1989 Baginski et al.
4,884,164 A 11/1989 Dzuira et al.
4,900,882 A 2/1990 Bernard et al.
4,910,485 A 3/1990 Bolongeat-Mobleu et al.
4,914,541 A 4/1990 Tripodi et al.
4,916,420 A 4/1990 Bartolo et al.
4,916,421 A 4/1990 Pardini et al.
4,926,282 A 5/1990 McGhie
4,935,590 A 6/1990 Malkin et al.
4,935,712 A 6/1990 Oyama Kazuaki et al.
4,937,706 A 6/1990 Schueller et al.
4,939,492 A 7/1990 Raso et al.
4,943,691 A 7/1990 Mertz et al.
4,943,888 A 7/1990 Jacob et al.
4,950,855 A 8/1990 Bolonegeat-Mobleu et al.
4,951,019 A 8/1990 Gula
4,952,897 A 8/1990 Barnel et al.
4,958,135 A 9/1990 Baginski et al.
4,965,543 A 10/1990 Batteux
4,983,788 A 1/1991 Pardini
5,001,313 A 3/1991 Leclerq et al.
5,004,878 A 4/1991 Seymour et al.
5,030,804 A 7/1991 Abri
5,057,655 A 10/1991 Kersusan et al.
5,077,627 A 12/1991 Fraisse
5,083,081 A 1/1992 Barrault et al.
5,095,183 A 3/1992 Raphard et al.
5,103,198 A 4/1992 Morel et al.
5,115,371 A 5/1992 Tripodi
5,120,921 A 6/1992 DiMarco et al.
5,132,865 A 7/1992 Mertz et al.
5,138,121 A 8/1992 Streich et al.
5,140,115 A 8/1992 Morris
5,153,802 A 10/1992 Mertz et al.
5,155,315 A 10/1992 Malkin et al.
5,166,483 A 11/1992 Kersusan et al.
5,172,087 A 12/1992 Castonguay et al.
5,178,504 A 1/1993 Falchi
5,184,717 A 2/1993 Chou et al.
5,187,339 A 2/1993 Lissandrin
5,198,956 A 3/1993 Dvorak
5,200,724 A 4/1993 Gula et al.
5,210,385 A 5/1993 Morel et al.
5,239,150 A 8/1993 Bolongeat-Mobleu et al.
5,260,533 A * 11/1993 Livesey et al. ..... 200/401
5,262,744 A 11/1993 Arnold et al.
5,280,144 A 1/1994 Bolongeat-Mobleu et al.
5,281,776 A 1/1994 Morel et al.
5,296,660 A 3/1994 Morel et al.
5,296,664 A 3/1994 Crookston et al.
5,298,874 A 3/1994 Morel et al.
5,300,907 A 4/1994 Nereau et al.
5,310,971 A 5/1994 Vial et al.
5,313,180 A 5/1994 Vial et al.
5,317,471 A 5/1994 Izoard et al.
5,331,500 A 7/1994 Corcoles et al.
5,334,808 A 8/1994 Bur et al.
5,341,191 A 8/1994 Crookston et al.
5,347,096 A 9/1994 Bolongeat-Mobleu et al.
5,347,097 A 9/1994 Bolongeat-Mobleu et al.
5,350,892 A 9/1994 Rozier
5,357,066 A 10/1994 Morel et al.
5,357,068 A 10/1994 Rozier
5,357,394 A 10/1994 Piney
5,361,052 A 11/1994 Ferullo et al.
5,373,130 A 12/1994 Barrault et al.
5,379,013 A 1/1995 Coudert
5,424,701 A 6/1995 Castonguay et al.
5,438,176 A 8/1995 Bonnardel et al.
5,440,088 A 8/1995 Coudert et al.
5,449,871 A 9/1995 Batteux et al.
5,450,048 A 9/1995 Leger et al.
5,451,729 A 9/1995 Onderka et al.
5,457,295 A 10/1995 Tanibe et al.
5,467,069 A 11/1995 Payet-Burin et al.
5,469,121 A 11/1995 Payet-Burin
5,475,558 A 12/1995 Barjonnet et al.
5,477,016 A 12/1995 Baginski et al.
5,479,143 A 12/1995 Payet-Burin
5,483,212 A 1/1996 Lankuttis et al.
5,485,343 A 1/1996 Santos et al.
D367,265 S 2/1996 Yamagata et al.
5,493,083 A 2/1996 Olivier
5,504,284 A 4/1996 Lazareth et al.
5,504,290 A 4/1996 Baginski et al.
5,510,761 A 4/1996 Boder et al.

| | | | |
|---|---|---|---|
| 5,512,720 | A | 4/1996 | Coudert et al. |
| 5,515,018 | A | 5/1996 | DiMarco et al. |
| 5,519,561 | A | 5/1996 | Mrenna et al. |
| 5,534,674 | A | 7/1996 | Steffens |
| 5,534,832 | A | 7/1996 | Duchemin et al. |
| 5,534,835 | A | 7/1996 | McColloch et al. |
| 5,534,840 | A | 7/1996 | Cuingnet |
| 5,539,168 | A | 7/1996 | Linzenich |
| 5,543,595 | A | 8/1996 | Mader et al. |
| 5,552,755 | A | 9/1996 | Fello et al. |
| 5,581,219 | A | 12/1996 | Nozawa et al. |
| 5,604,656 | A | 2/1997 | Derrick et al. |
| 5,608,367 | A | 3/1997 | Zoller et al. |
| 5,784,233 | A | 7/1998 | Bastard et al. |
| 5,791,457 | A | 8/1998 | Castonguay et al. |

FOREIGN PATENT DOCUMENTS

| | | | |
|---|---|---|---|
| DE | 30 47 360 | | 6/1982 |
| DE | 38 02 184 | | 8/1989 |
| DE | 38 43 277 | | 6/1990 |
| DE | 44 19 240 | | 1/1995 |
| EP | 0 061 092 | | 9/1982 |
| EP | 0 064 906 | | 11/1982 |
| EP | 0 066 486 | | 12/1982 |
| EP | 0 076 719 | | 4/1983 |
| EP | 0 117 094 | | 8/1984 |
| EP | 0 140 761 | | 5/1985 |
| EP | 0 174 904 | | 3/1986 |
| EP | 0 196 241 | | 10/1986 |
| EP | 0 224 396 | | 6/1987 |
| EP | 0 235 479 | | 9/1987 |
| EP | 0 239 460 | | 9/1987 |
| EP | 0 258 090 | | 3/1988 |
| EP | 0 264 313 | | 4/1988 |
| EP | 0 264 314 | | 4/1988 |
| EP | 0 283 189 | | 9/1988 |
| EP | 0 283 358 | | 9/1988 |
| EP | 0 291 374 | | 11/1988 |
| EP | 0 295 155 | | 12/1988 |
| EP | 0 295 158 | | 12/1988 |
| EP | 0 309 923 | | 4/1989 |
| EP | 0 313 106 | | 4/1989 |
| EP | 0 313 422 | | 4/1989 |
| EP | 0 314 540 | | 5/1989 |
| EP | 0 331 586 | | 9/1989 |
| EP | 0 337 900 | | 10/1989 |
| EP | 0 342 133 | | 11/1989 |
| EP | 0 367 690 | | 5/1990 |
| EP | 0 371 887 | | 6/1990 |
| EP | 0 375 568 | | 6/1990 |
| EP | 0 394 144 | | 10/1990 |
| EP | 0 394 922 | | 10/1990 |
| EP | 0 399 282 | | 11/1990 |
| EP | 0 407 310 | | 1/1991 |
| EP | 0 452 230 | | 10/1991 |
| EP | 0 555 158 | | 8/1993 |
| EP | 0555158 | | 8/1993 |
| EP | 0 560 697 | | 9/1993 |
| EP | 0 567 416 | | 10/1993 |
| EP | 0 595 730 | | 5/1994 |
| EP | 0 619 591 | | 10/1994 |
| EP | 0 665 569 | | 8/1995 |
| EP | 0 700 140 | | 3/1996 |
| EP | 0889498 | A2 | 6/1998 |
| EP | 0 889 498 | | 1/1999 |
| FR | 2171863 | | 8/1973 |
| FR | 2 410 353 | | 6/1979 |
| FR | 2 512 582 | | 3/1983 |
| FR | 2 553 943 | | 4/1985 |
| FR | 2 592 998 | | 7/1987 |
| FR | 2 682 531 | | 4/1993 |
| FR | 2682531 | | 4/1993 |
| FR | 2 697 670 | | 5/1994 |
| FR | 2 699 324 | | 6/1994 |
| FR | 2 714 771 | | 7/1995 |
| GB | 2 233 155 | | 1/1991 |
| WO | 92/00598 | | 1/1992 |
| WO | 92/05649 | | 4/1992 |
| WO | 94/00901 | | 1/1994 |

* cited by examiner

CIRCUIT INTERRUPTER OPERATING MECHANISM

CROSS REFERENCE TO RELATED APPLICATIONS

This Application is a divisional application of U.S. application Ser. No. 09/516,475 filed Mar. 1, 2000, which is hereby incorporated by reference in its entirety.

BACKGROUND OF INVENTION

The present invention is directed to circuit interrupters, and more particularly to circuit interrupter operating mechanisms.

Circuit interrupter operating mechanisms are used to manually control the opening and closing of movable contact structures within circuit interrupters. Additionally, these operating mechanisms in response to a trip signal, for example, from an actuator device, will rapidly open the movable contact structure and interrupt the circuit. To transfer the forces (e.g., to manually control the contact structure or to rapidly trip the structure with an actuator), operating mechanisms employ powerful springs and linkage arrangements. The spring energy provides a high output force to the separable contacts.

Commonly, multiple contacts, each disposed within a cassette, are arranged within a circuit breaker system for protection of individual phases of current. The operating mechanism is positioned over one of the cassettes and generally connected to all of the cassettes in the system. Because of the close position between each of the cassettes, and between each cassette and the operating mechanism, the space available for movable components is minimal. It would be desirable to maximize the available space to reduce friction between movable components within the operating mechanism.

Furthermore, circuit breaker arrangements are provided for 3-pole and 4-pole devices. Inherently, the position of a circuit breaker operating mechanism relative to a 4-pole device is asymmetrical. Therefore, it will be desirable to provide a circuit breaker operating mechanism that maximizes the output force to the poles of the circuit breaker system while minimizing the lost forces due to, for example, friction.

SUMMARY OF INVENTION

An operating mechanism for controlling and tripping a separable contact structure arranged in a protected circuit is provided by the present invention. The separable contact structure is movable between a first and second position. The first position permits current to flow through the protected circuit and the second position prohibits current from flowing through the circuit. The mechanism includes a frame, a drive member pivotally coupled to the frame, a spring pivotally connecting the drive member to a drive connector, an upper link pivotally seated on the drive connector, a lower link member pivotally coupled to the drive connector, a crank member pivotally coupled to the lower link member for interfacing the separable contact structure, and a cradle member pivotally secured to the frame and pivotally securing the upper link. The cradle member is configured for being releasably engaged by a latch assembly, which is displaced upon occurrence of a predetermined condition in the circuit. The mechanism is movable between a tripped position, a reset position, an off position, and an on position.

In one exemplary embodiment, spacers are operatively positioned between movable members, and protrusions are operatively formed on the enclosure. The spacers and protrusions serve to widen the stances of the operating mechanism for force distribution purposes, and also to minimize friction between movable components.

DETAILED DESCRIPTION

Figure 1:
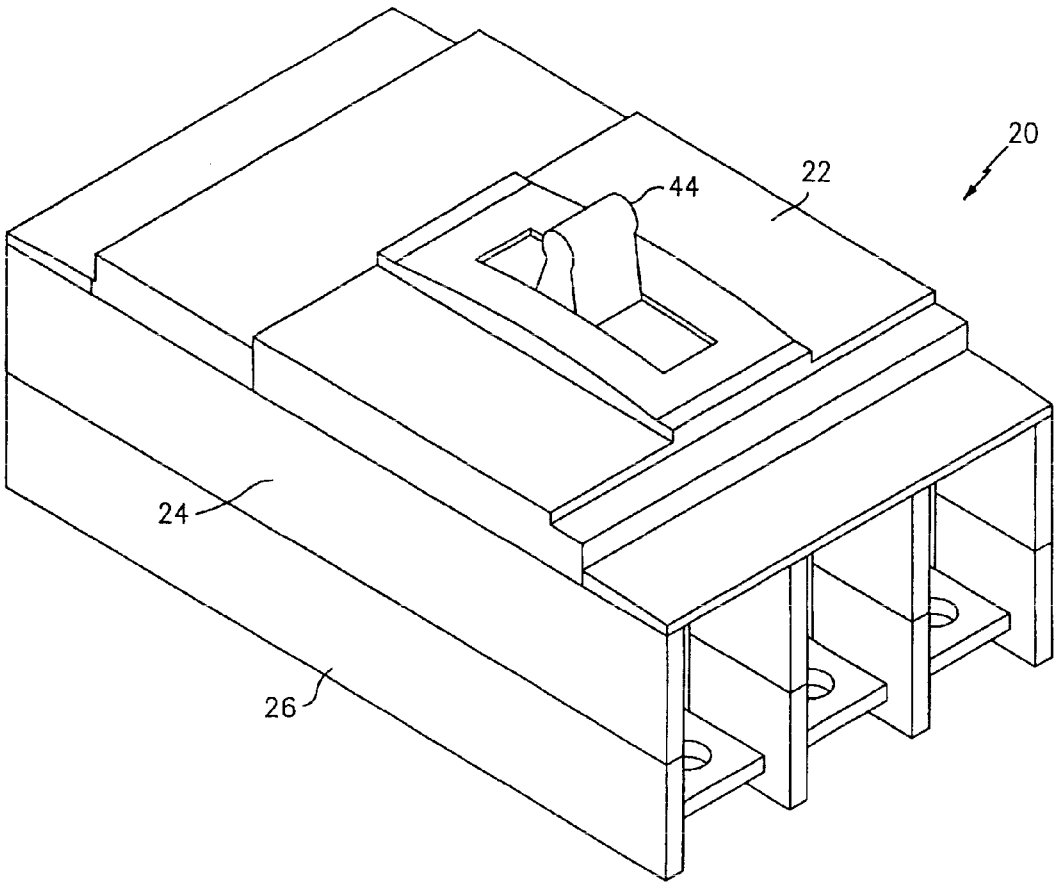
FIG. 1 is an isometric view of a molded case circuit breaker employing an operating mechanism embodied by the present invention.
Figure 2:
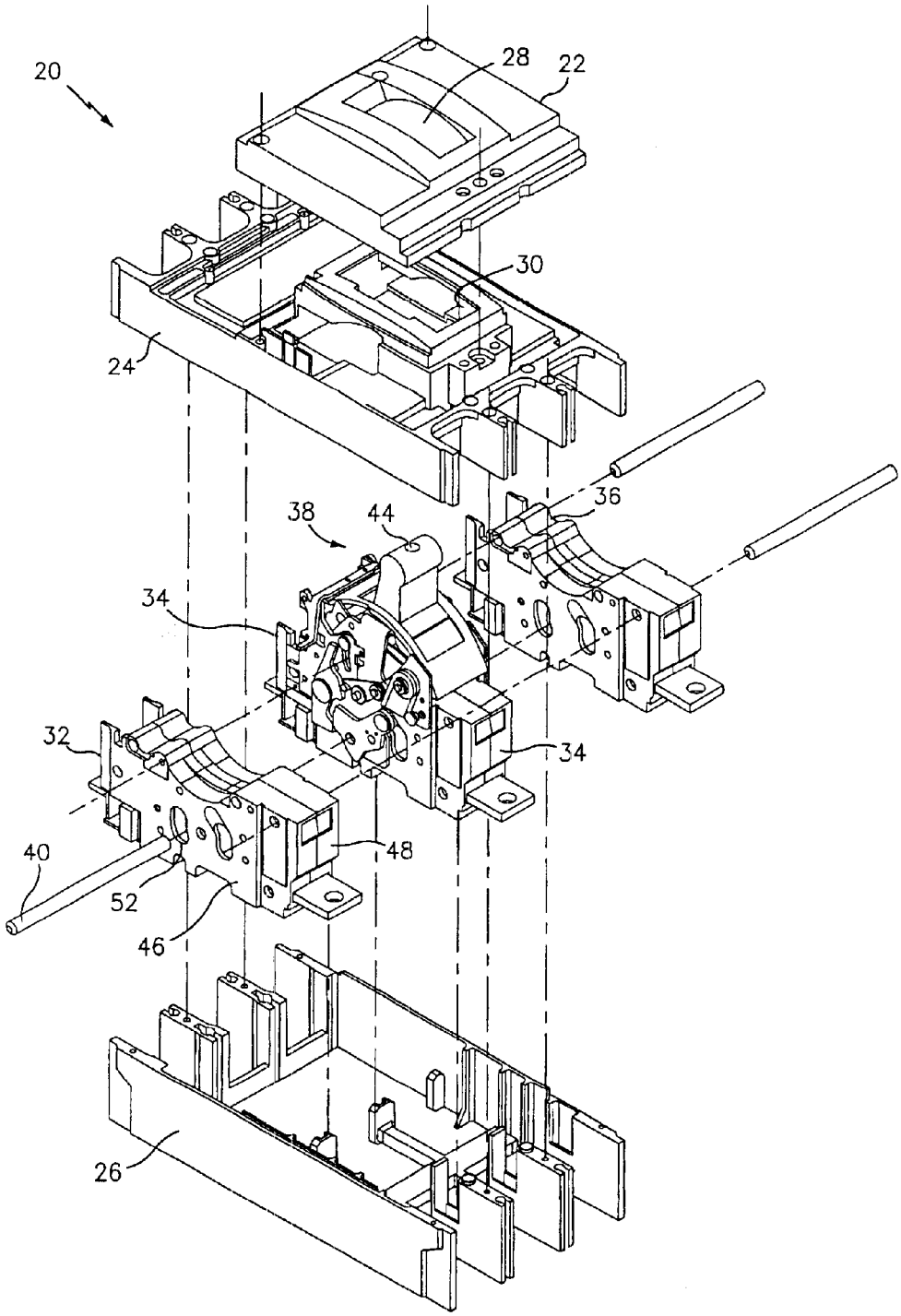
FIG. 2 is an exploded view of the circuit breaker of FIG. 1.

In an exemplary embodiment of the present invention, and referring to FIGS. 1 and 2, a circuit breaker 20 is shown. Circuit breaker 20 generally includes a molded case having a top cover 22 attached to a mid cover 24 coupled to a base 26. An opening 28, formed generally centrally within top cover 22, is positioned to mate with a corresponding mid cover opening 30, which is accordingly aligned with opening 28 when mid cover 24 and top cover 22 are coupled to one another.

In a 3-pole system (i.e., corresponding with three phases of current), three rotary cassettes 32, 34 and 36 are disposed within base 26. Cassettes 32, 34 and 36 are commonly operated by an interface between an operating mechanism 38 via a cross pin 40. Operating mechanism 38 is positioned and configured atop cassette 34, which is generally disposed intermediate to cassettes 32 and 36. Operating mechanism 38 operates substantially as described herein and as described in U.S. patent application Ser. No. 09/196,706 entitled "Circuit Breaker Mechanism for a Rotary Contact Assembly".

A toggle handle 44 extends through openings 28 and 30 and allows for external operation of cassettes 32, 34 and 36. Examples of rotary contact structures that may be operated by operating mechanism 38 are described in more detail in U.S. patent application Ser. Nos. 09/087,038 and 09/384,908, both entitled "Rotary Contact Assembly For High-Ampere Rated Circuit Breakers" and U.S. patent application Ser. No. 09/384,495, entitled "Supplemental Trip Unit For Rotary Circuit Interrupters". Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38.

Figure 3:
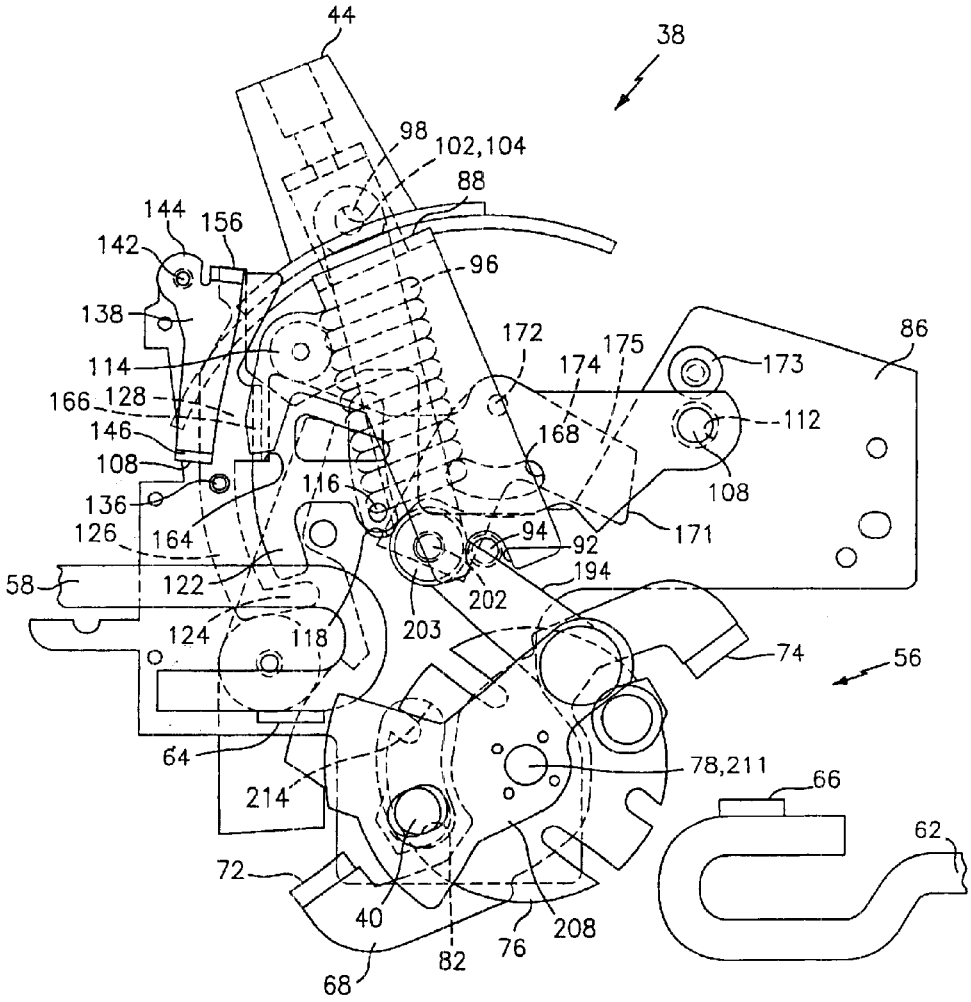
FIG. 3 is a partial sectional view of a rotary contact structure and operating mechanism embodied by the present invention in the "off" position.
Figure 4:
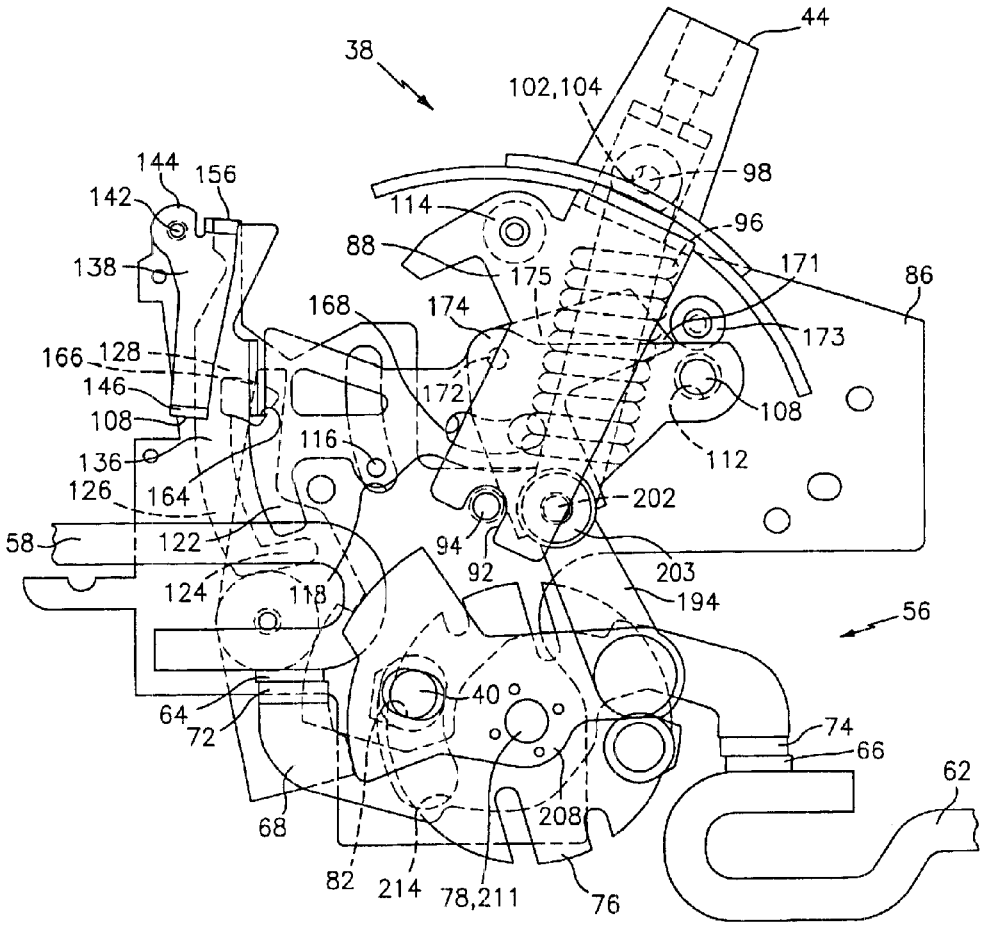
FIG. 4 is a partial sectional view of the rotary contact structure and operating mechanism of FIG. 3 in the "on" position.
Figure 5:
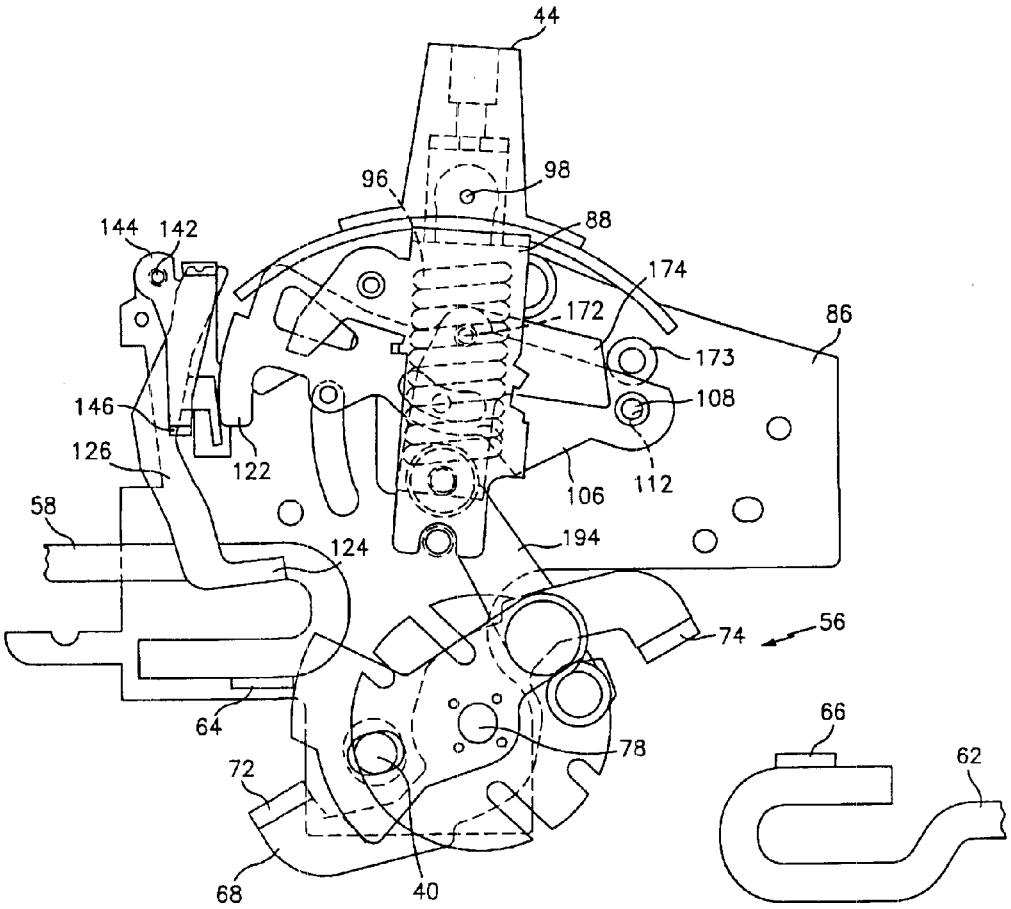
FIG. 5 is a partial sectional view of the rotary contact structure and operating mechanism of FIGS. 3 and 4 in the "tripped" position.

Referring now to FIGS. 3, 4, and 5, an exemplary rotary contact assembly 56 that is disposed within each cassette 32, 34, 36 is shown in the "off", "on" and "tripped" conditions, respectively. Also depicted are partial side views of operating mechanism 38, the components of which are described in greater detail further herein. Rotary contact assembly 56 includes a line side contact strap 58 and load side contact strap 62 for connection with a power source and a protected circuit (not shown), respectively. Line side contact strap 58 includes a stationary contact 64 and load side contact strap 62 includes a stationary contact 66. Rotary contact assembly 56 further includes a movable contact arm 68 having a set of contacts 72 and 74 that mate with stationary contacts 64 and 66, respectively. In the "off" position (FIG. 3) of operating mechanism 38, wherein toggle handle 44 is oriented to the left (e.g., via a manual or mechanical force), contacts 72 and 74 are separated from stationary contacts 64 and 66, thereby preventing current from flowing through contact arm 68.

In the "on" position (FIG. 4) of operating mechanism 38, wherein toggle handle 44 is oriented to the right as depicted in FIG. 3 (e.g., via a manual or mechanical force), contacts 72 and 74 are mated with stationary contacts 64 and 66, thereby allowing current to flow through contact arm 68. In the "tripped" position (FIG. 5) of operating mechanism 38, toggle handle 44 is oriented between the "on" position and the "off" position (typically by the release of mechanism springs within operating mechanism 38, described in greater detail herein). In this "tripped" position, contacts 72 and 74 are separated from stationary contacts 64 and 66 by the action of operating mechanism 38, thereby preventing current from flowing through contact arm 68. After operating mechanism 38 is in the "tripped" position, it must ultimately be returned to the "on" position for operation. This is effectuated by applying a reset force to move toggle handle 44 to a "reset" condition, which is beyond the "off" position (i.e., further to the left of the "off" position in FIG. 3), and then back to the "on" position. This reset force must be high enough to overcome the mechanism springs, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off " and "tripped" position.

Figure 6:
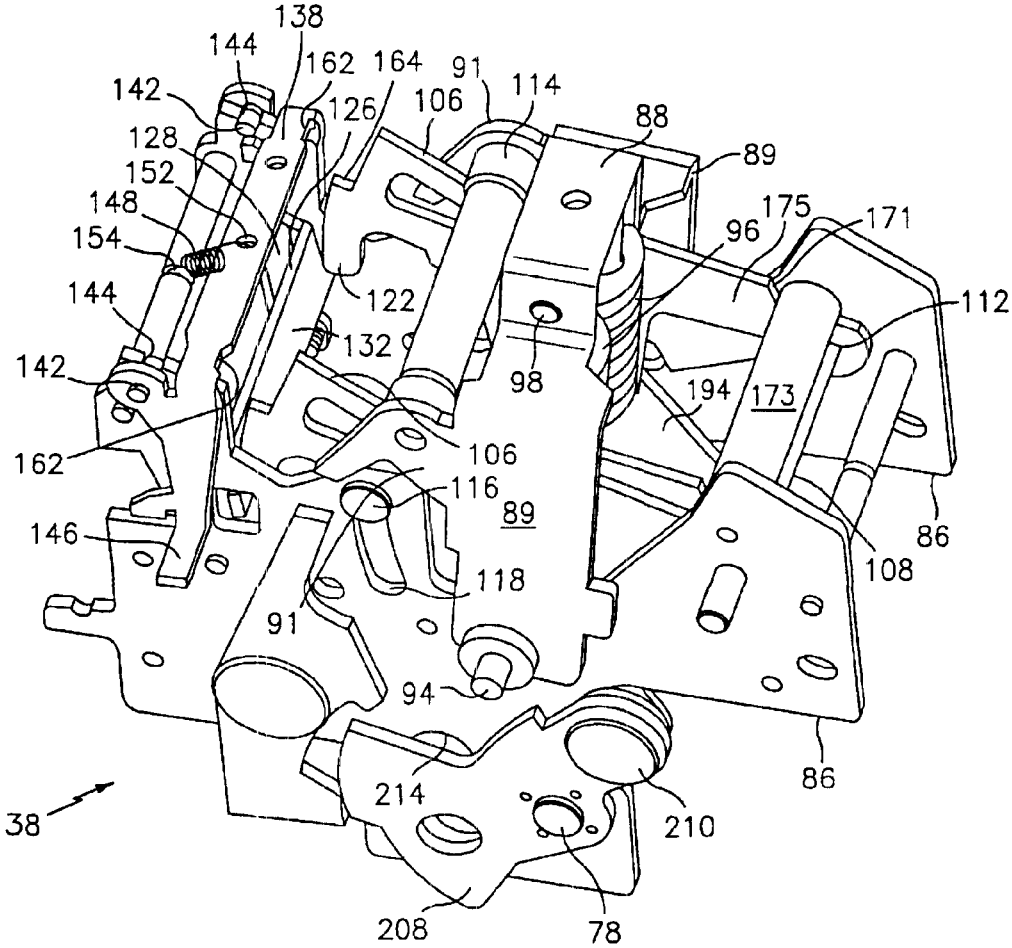
FIG. 6 is an isometric view of the operating mechanism.
Figure 7:
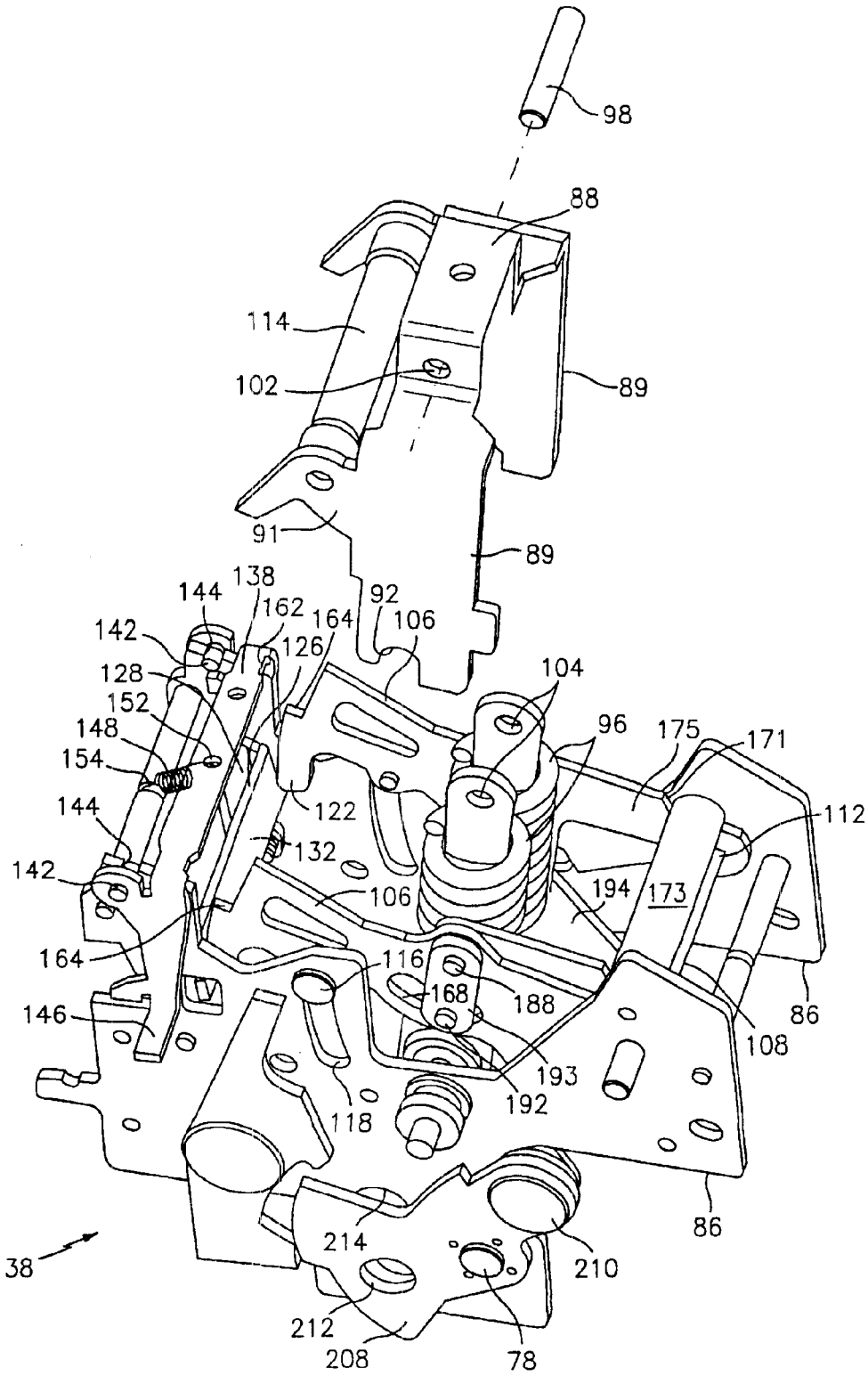
FIG. 7 is a partially exploded view of the operating mechanism.
Figure 8:
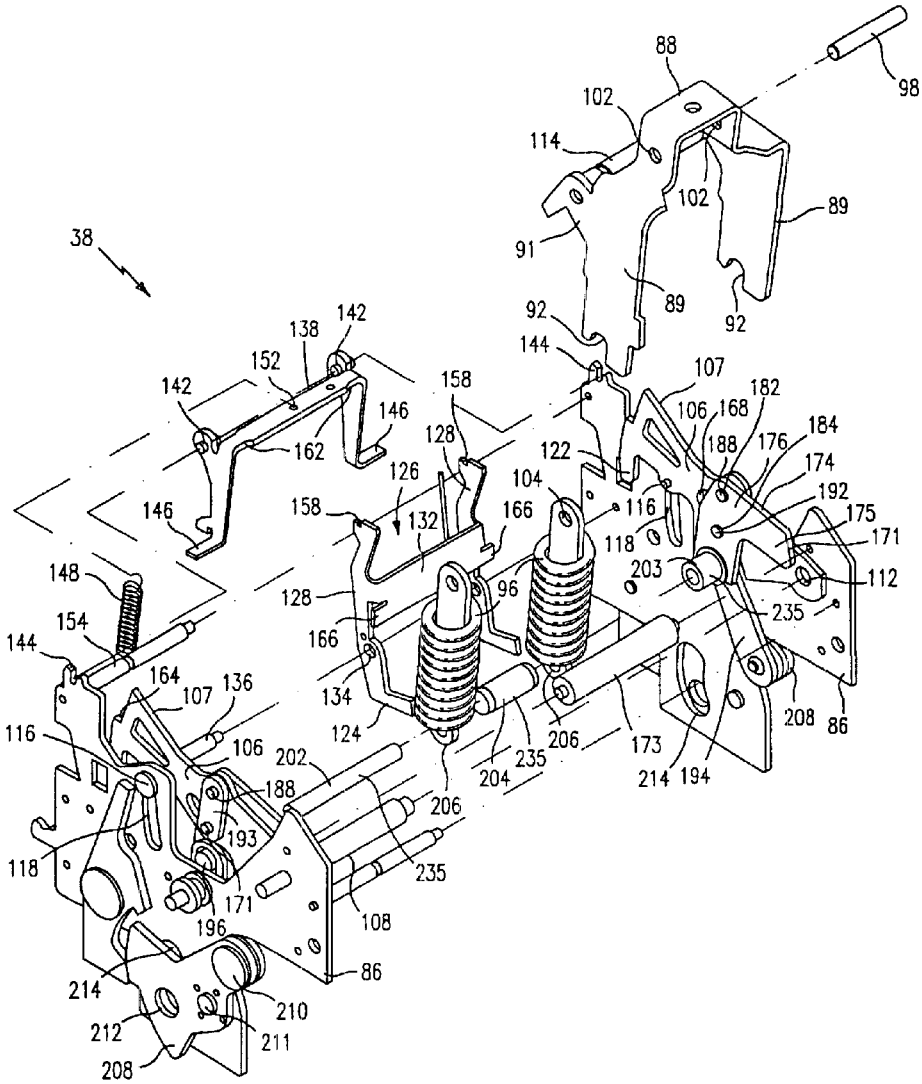
FIG. 8 is another partially exploded view of the operating mechanism.

Referring now to FIGS. 6–8, the components of operating mechanism 38 will now be detailed. As viewed in FIGS. 6–8, operating mechanism 38 is in the "tripped" position. Operating mechanism 38 has operating mechanism side frames 86 configured and positioned to straddle sidewalls 46, 48 of cassette 34 (FIG. 2).

Toggle handle 44 (FIG. 2) is rigidly interconnected with a drive member or handle yoke 88. Handle yoke 88 includes opposing side portions 89. Each side portion 89 includes an extension 91 at to the top of side portion 89, and a U-shaped portion 92 at the bottom portion of each side portion 89. U-shaped portions 92 are rotatably positioned on a pair of bearing portions 94 protruding outwardly from side frames 86. Bearing portions 94 are configured to retain handle yoke 88, for example, with a securement washer. Handle yoke 88 further includes a roller pin 114 extending between extensions 91.

Handle yoke 88 is connected to a set of powerful mechanism springs 96 by a spring anchor 98, which is generally supported within a pair of openings 102 in handle yoke 88 and arranged through a complementary set of openings 104 on the top portion of mechanism springs 96.

Figure 9:
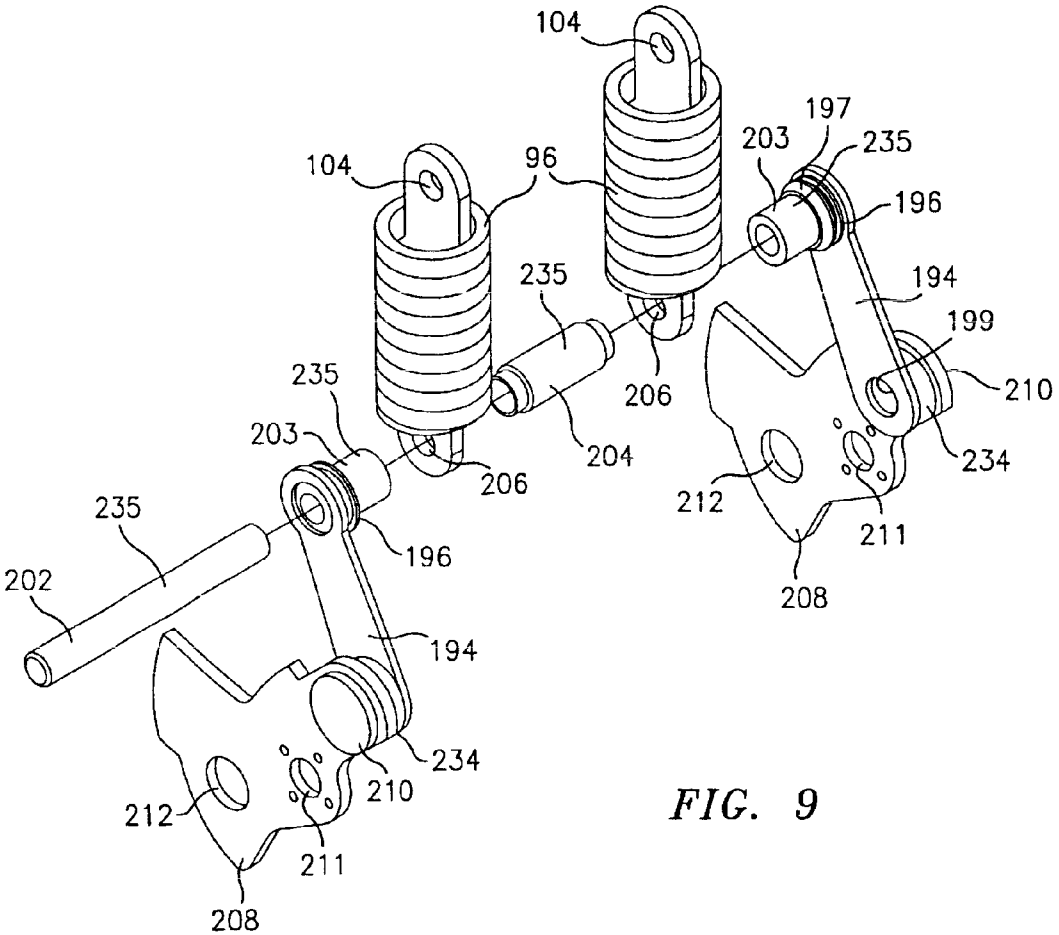
FIG. 9 is an exploded view of a pair of mechanism springs and associated linkage components within the operating mechanism.

Referring to FIG. 9, the bottom portion of mechanism springs 96 include a pair of openings 206. A drive connector 235 operative couples mechanism springs 96 to other operating mechanism components. Drive connector 235 comprises a pin 202 disposed through openings 206, a set of side tubes 203 arranged on pin 202 adjacent to the outside surface of the bottom portion of mechanism springs 96, (and a central tube 204 arranged on pin 202 between the inside surfaces of the bottom portions of mechanism springs 96. Central tube 204 includes step portions at each end, generally configured to maintain a suitable distance between mechanism springs 96. While drive connector 235 is detailed herein as tubes 203, 204 and a pill 202, any means to connect the springs to the mechanism components are contemplated.

Figure 10:
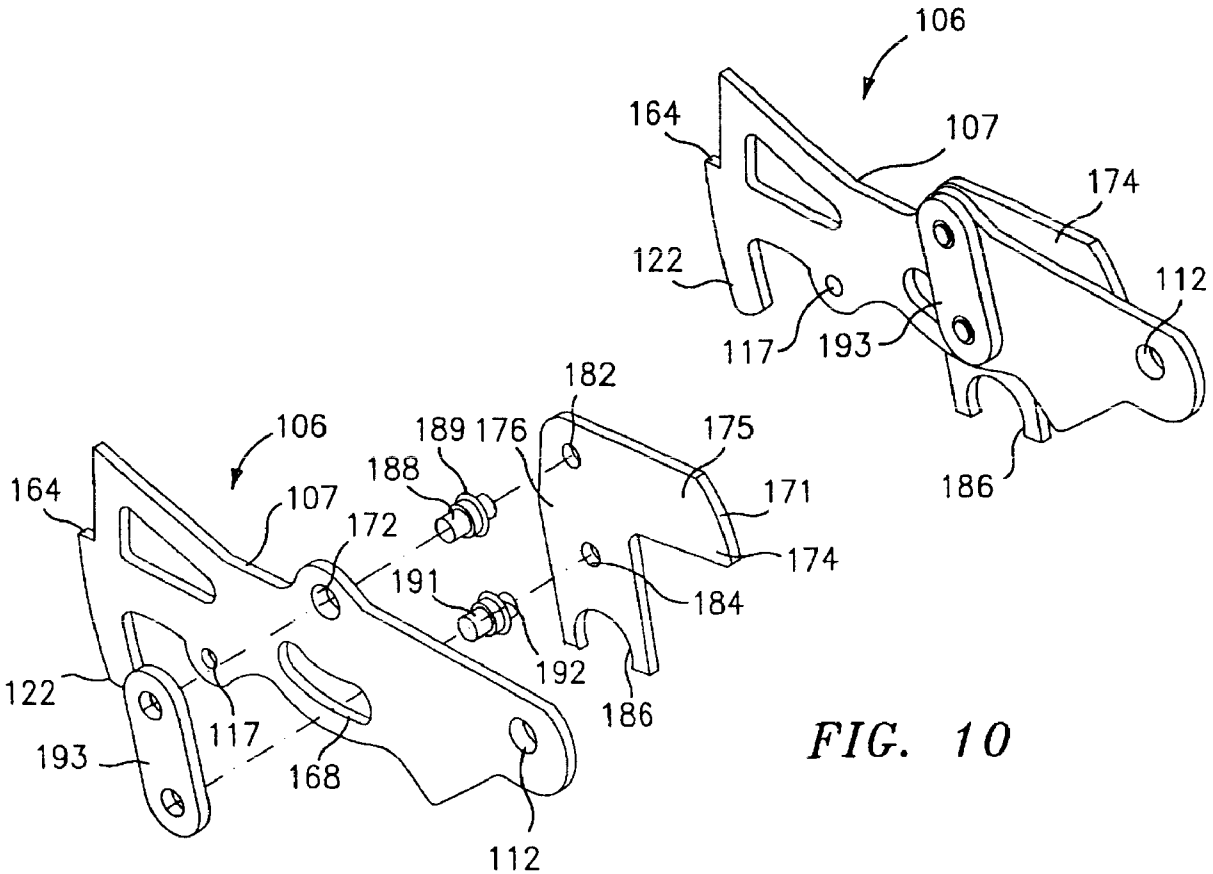
FIG. 10 is an isometric and exploded view of linkage components within the operating mechanism.

Referring to FIGS. 8 and 10, a pair of cradles 106 are disposed adjacent to side frames 86 and pivot on a pin 108 disposed through an opening 112 approximately at the end of each cradle 106. Each cradle 106 includes an edge surface 107, an arm 122 depending downwardly, and a cradle latch surface 164 above arm 122. Edge surface 107 is positioned generally at the portion of cradle 106 in the range of contact with roller pin 114. The movement of each cradle 106 is guided by a rivet 116 disposed through an arcuate slot 118 within each side frame 86. Rivets 116 are disposed within an opening 117 on each the cradle 106. An arcuate slot 168 is positioned intermediate to opening 112 and opening 117 on each cradle 106. An opening 172 is positioned above slot 168.

Referring back to FIGS. 6–8, a primary latch 126 is positioned within side frame 86. Primary latch 126 includes a pair of side portions 128. Each side portion 128 includes a bent leg 124 at the lower portion thereof. Side portions 128 are interconnected by a central portion 132. A set of extensions 166 depend outwardly from central portion 132 positioned to align with cradle latch surfaces 164.

Side portions 128 each include an opening 134 positioned so that primary latch 126 is rotatably disposed on a pin 136. Pin 136 is secured to each side frame 86. A set of upper side portions 156 are defined at the top end of side portions 128. Each upper side portion 156 has a primary latch surface 158.

A secondary latch 138 is pivotally straddled over side frames 86. Secondary latch 138 includes a set of pins 142 disposed in a complementary pair of notches 144 on each side frame 86. Secondary latch 138 includes a pair of secondary latch trip tabs 146 that extend perpendicularly from operating mechanism 38 as to allow an interface with, for example, an actuator (not shown), to release the engagement between primary latch 126 and secondary latch 138 thereby causing operating mechanism 38 to move to the "tripped" position (e.g., as in FIG. 5), described below.

Secondary latch 138 includes a set of latch surfaces 162, that align with primary latch surfaces 158.

Secondary latch 138 is biased in the clockwise direction due to the pulling forces of a spring 148. Spring 148 has a first end connected at an opening 152 upon secondary latch 138, and a second end connected at a frame cross pin 154 disposed between frames 86.

Referring to FIGS. 8 and 10, a set of upper links 174 are connected to cradles 106. Upper links 174 generally have a right angle shape. Legs 175 (in a substantially horizontal configuration and FIGS. 8 and 10) of upper links 174 each have a cam portion 171 that interfaces a roller 173 disposed between frames 86. Legs 176 (in a substantially vertical configuration in FIGS. 8 and 10) of upper links 174 each have a pair of openings 182, 184 and a U-shaped portion 186 at the bottom end thereof. Opening 184 is intermediate to opening 182 and U-shaped portion 186. Upper links 174 connect to cradle 106 via a securement structure such as a rivet pin 188 disposed through opening 172 and opening 182, and a securement structure such as a rivet pin 191 disposed through slot 168 and opening 184. Rivet pins 188, 191 both attach to a connector 193 to secure each upper link 174 to each cradle 106. Each pin 188, 191 includes raised portions 189, 192, respectively. Raised portions 189, 192 are provided to maintain a space between each upper link 174 and each cradle 106. The space serves to reduce or eliminate friction between upper link 174 and cradle 106 during any operating mechanism motion, and also to spread force loading between cradles 106 and upper links 174.

Figure 11:
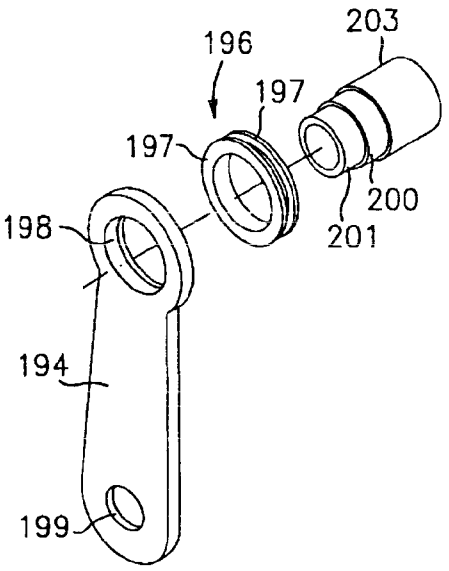
FIG. 11 is a front, isometric, and partially exploded isometric views of a linkage component within the operating mechanism.
Figure 11:
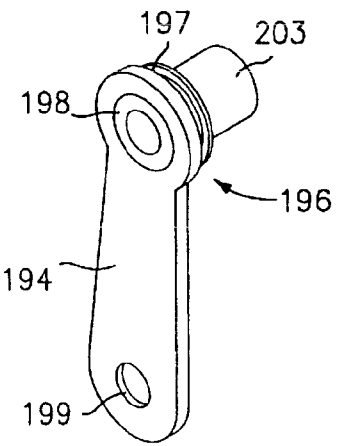
Figure 11:
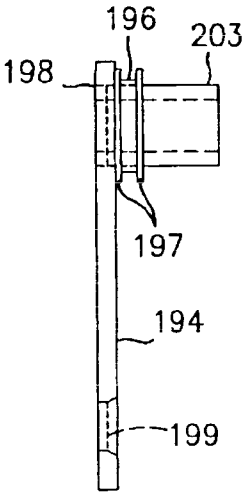

Upper links 174 are each interconnected with a lower link 194. Referring now to FIGS. 8,10 and 11, U-shaped portion 186 of each upper link 174 is disposed in a complementary set of bearing washers 196. Bearing washers 196 are arranged on each side tube 203 between a first step portion 200 of side tube 203 and an opening 198 at one end of lower link 194. Bearing washers 196 are configured to include side walls 197 spaced apart sufficiently so that U-shaped portions 186 of upper links 174 fit in bearing washer 196. Each side tube 203 is configured to have a second step portion 201. Each second step portion 201 is disposed through openings 198. Pin 202 is disposed through side tubes 203 and central tube 204. Pin 202 interfaces upper links 174 and lower links 194 via side tubes 203. Therefore, each side tube 203 is a common interface point for upper link 174 (as pivotally seated within side walls 197 of bearing washer 196), lower link 194 and mechanism springs 96.

Figure 12:
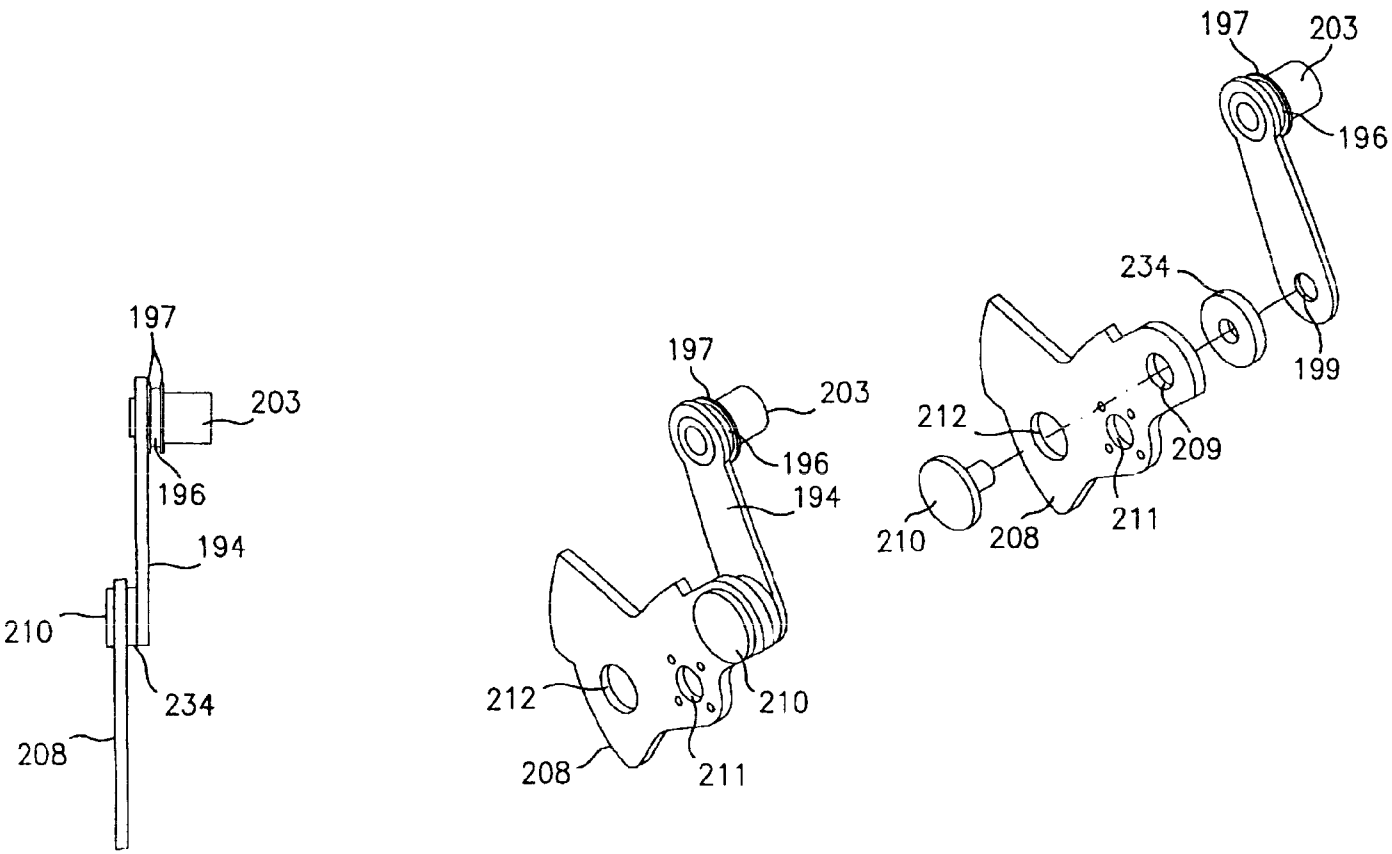
FIG. 12 is a front, isometric, and partially exploded isometric views of linkage components within the operating mechanism.

Referring to FIG. 12, each lower link 194 is interconnected with a crank 208 via a pivotal rivet 210 disposed through an opening 199 in lower link 194 and an opening 209 in crank 208. Each crank 208 pivots about a center 211. Crank 208 has an opening 212 where cross pin 40 (FIG. 2) passes through into arcuate slot 52 of cassettes 32, 34 and 36 (FIG. 2) and a complementary set of arcuate slots 214 on each side frame 86 (FIG. 8).

A spacer 234 is included on each pivotal rivet 210 between each lower link 194 and crank 208. Spacers 234 spread the force loading from lower links 194 to cranks 208 over a wider base, and also reduces friction between lower links 194 and cranks 208, thereby minimizing the likelihood of binding (e.g., when operating mechanism 38 is changed from the "off" position to the "on" position manually or mechanically, or when operating mechanism 38 is changed from the "on" position to the "tripped" position of the release of primary latch 126 and secondary latch 138).

Figure 13:
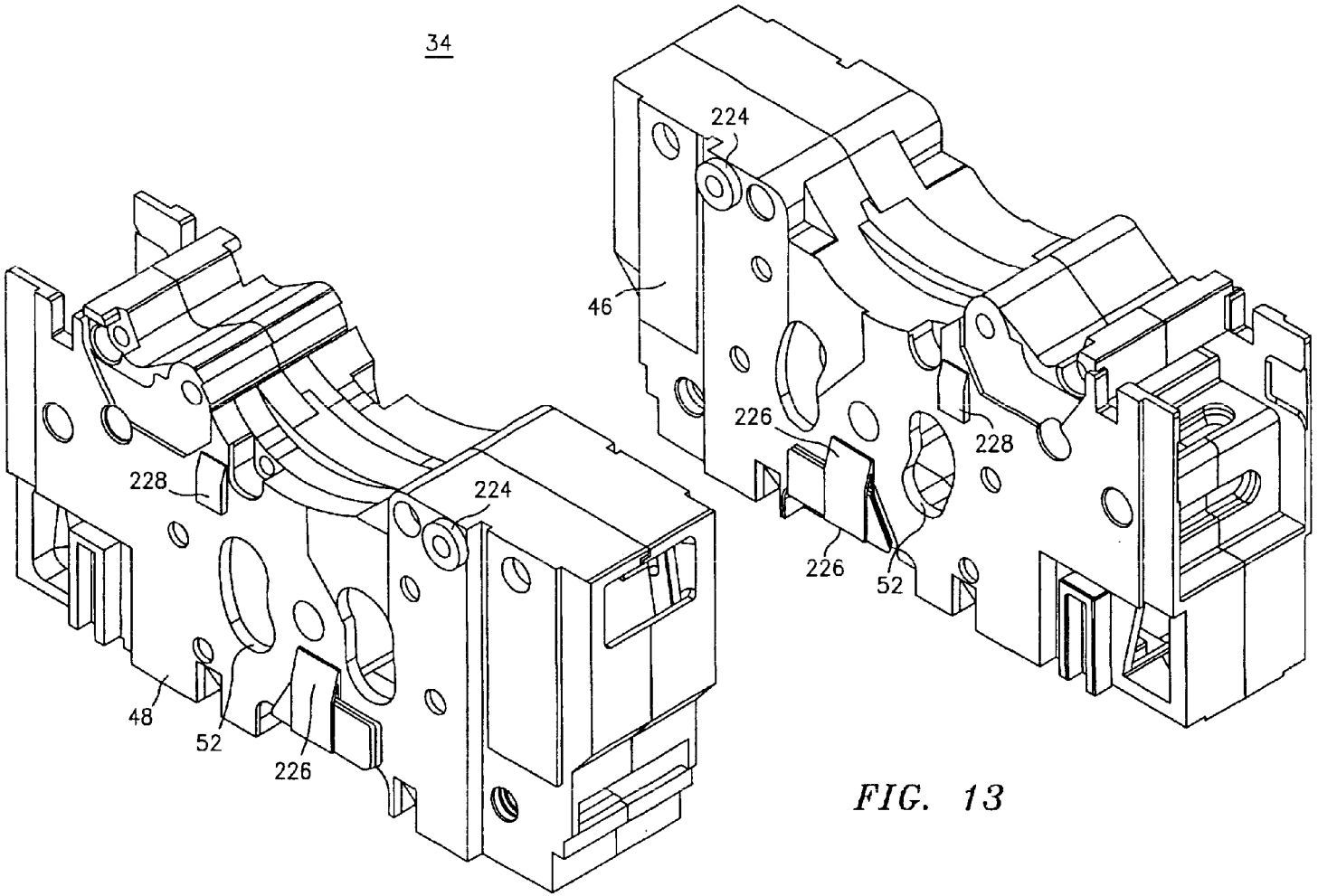
FIGS. 13 depicts isometric views of the opposing sides of a cassette employed within the circuit interrupter.

Referring to FIG. 13, views of both sidewalls 46 and 48 of cassette 34 are depicted. Sidewalls 46 and 48 include protrusions or bosses 224, 226 and 228 thereon. Bosses 224, 226 and 228 are attached to sidewalls 46, 48, or can be molded features on sidewalls 46, 48. Note that cassette 34 is depicted and certain features are described herein because operating mechanism 38 straddles cassette 34, i.e., the central cassette, in circuit breaker 20. It is contemplated that the features may be incorporated in cassettes in other positions, and with or without operating mechanism 38 included thereon, for example, if it is beneficial from a manufacturing standpoint to include the features on all cassettes.

Figure 14:
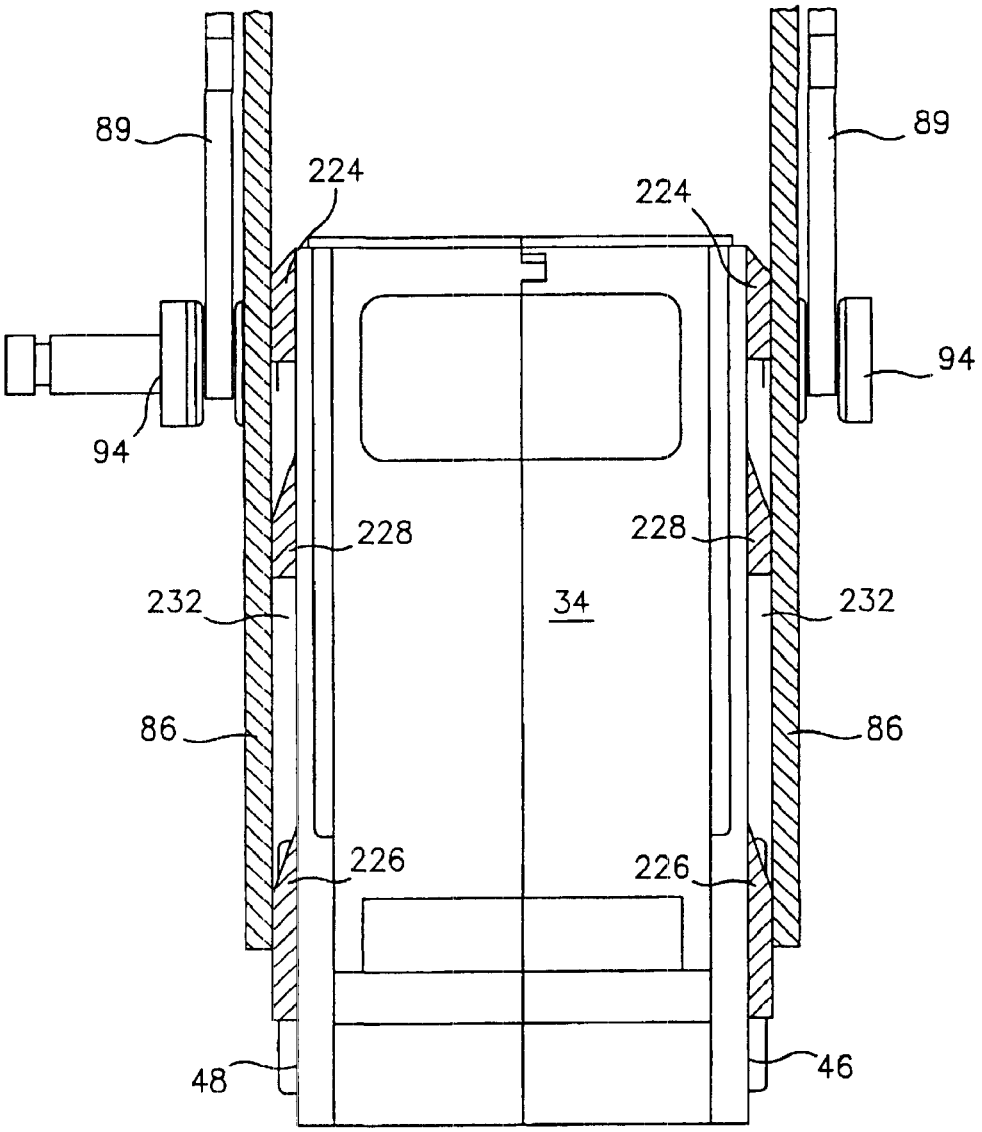
FIG. 14 is a front view of the cassette and the operating mechanism positioned thereon.
Figure 15:
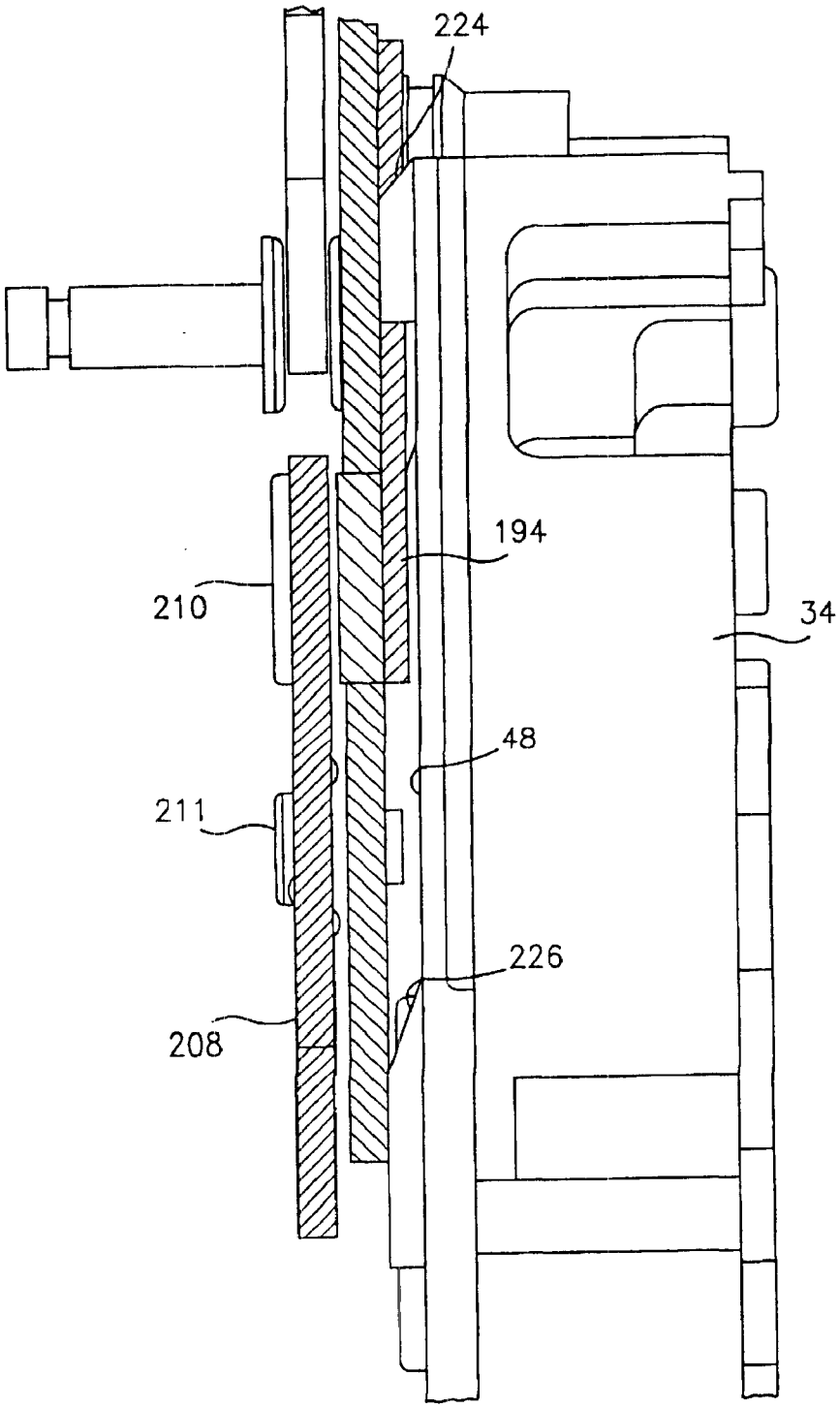
FIG. 15 is a partial front view of the cassette and the operating mechanism positioned thereon.

Referring now to FIG. 14, side frames 86 of operating mechanism 38 are positioned over sidewall 46, 48 of cassette 34. Portions of the inside surfaces of side frames 86 contact bosses 224, 226 and 228, creating a space 232 between each sidewall 46, 48 and each side frame 86. Referring now also to FIG. 15, space 232 allows lower links 194 to properly transmit motion to cranks 208 without binding or hindrance due to frictional interference from sidewalls 46, 48 or side frames 86.

Additionally, the provision of bosses 224, 226 and 228 widens the base of operating mechanism 38, allowing for force to be transmitted with increased stability. Accordingly, bosses 224, 226 and 228 should be dimensioned sufficiently large to allow clearance of links 194 without interfering with adjacent cassettes such as cassettes 32 and 36.

Referring back to FIGS. 3–5, the movement of operating mechanism 38 relative to rotary contact assembly 56 will be detailed.

Referring to FIG. 3, in the "off" position toggle handle 44 is rotated to the left and mechanism springs 96, lower link 194 and crank 208 are positioned to maintain contact arm 68 so that movable contacts 72, 74 remain separated from stationary contacts 64, 66. Operating mechanism 38 becomes set in the "off" position after a reReferring back to FIGS. 3–5, the movement of operating mechanism 38 relative to rotary contact assembly 56 will be detailed.set force properly aligns primary latch 126, secondary latch 138 and cradle 106 (e.g., after operating mechanism 38 has been tripped) and is released. Thus, when the reset force is released, extensions 166 of primary latch 126 rest upon cradle latch surfaces 164, and primary latch surfaces 158 rest upon secondary latch surfaces 162. Each upper link 174 and lower link 194 are bent with respect to each side tube 203. The line of forces generated by mechanism springs 96 (i.e., between spring anchor 98 and pin 202) is to the left of bearing portion 94 (as oriented in FIGS. 3–5). Cam surface 171 of upper link 174 is out of contact with roller 173.

Referring now to FIG. 4, a manual closing force was applied to toggle handle 44 to move it from the "off" position (i.e., FIG. 3) to the "on" position (i.e., to the right as oriented in FIG. 4). While the closing force is applied, upper links 174 rotate within arcuate slots 168 of cradles 106 about pins 188, and lower link 194 is driven to the right under bias of the mechanism spring 96. Raised portions 189 and 192 (FIG. 10) maintain a suitable space between the surfaces of upper links 174 and cradles 106 to prevent friction therebetween, which would increase the required set operating mechanism 38 from "off" to "on". Furthermore, side walls 197 of bearing washers 196 (FIG. 11) maintain the position of upper link 174 on side tube 203 and minimize likelihood of binding (e.g., so as to prevent upper link 174 from shifting into springs 96 or into lower link 194).

To align vertical leg 176 and lower link 194, the line of force generated by mechanism springs 96 is shifted to the right of bearing portion 94, which causes rivet 210 coupling lower link 194 and crank 208 to be driven downwardly and to rotate crank 208 clockwise about center 211. This, in turn, drives cross pin 40 to the upper end of arcuate slot 214. Therefore, the forces transmitted through cross pin 40 to rotary contact assembly 56 via opening 82 drive movable contacts 72, 74 into stationary contacts 64, 66. Each spacer 234 on pivotal rivet 210 (FIG. 9 and 12) maintain the appropriate distance between lower links 194 and cranks 208 to prevent interference or friction therebetween or from side frames 86.

The interface between primary latch 126 and secondary latch 138 (i.e., between primary latch surface 158 and secondary latch surface 162), and between cradles 106 and primary latch 126 (i.e., between extensions 166 and cradle latch surfaces 164) is not affected when a force is applied to toggle handle 44 to change from the "off" position to the "on" position.

Referring now to FIG. 5, in the "tripped" condition, secondary latch trip tab 146 has been displaced (e.g., by an actuator, not shown), and the interface between primary latch 126 and secondary latch 138 is released. Extensions 166 of primary latch 126 are disengaged from cradle latch surfaces 164, and cradles 106 is rotated clockwise about pin 108 (i.e., motion guided by rivet 116 in arcuate slot 118). The movement of cradle 106 transmits a force via rivets 188,191 to upper link 174 (having cam surface 171). After a short predetermined rotation, cam surface 171 of upper link 174 contacts roller 173. The force resulting from the contact of cam surface 171 on roller 173 causes upper link 174 and lower link 194 to buckle and allows mechanism springs 96 to pull lower link 194 via pin 202. In turn, lower link 194 transmits a force to crank 208 (i.e., via rivet 210), causing crank 208 to rotate counter clockwise about center 211 and drive cross pin 40 to the lower portion of arcuate slot 214. The forces transmitted through cross pin 40 to rotary contact assembly 56 via opening 82 cause movable contacts 72, 74 to separate from stationary contacts 64, 66.

As described above with respect to the setting from "off" to "on", raised portions 189 and 192 (FIG. 10) maintain a suitable space between the surfaces of upper links 174 and cradles 106 to prevent friction therebetween. Furthermore, side walls 197 of bearing washers 196 (FIG. 11) maintain the position of upper link 174 on side tube 203 and minimize likelihood of binding (e.g., so as to prevent upper link 174 from shifting into springs 96 or into lower link 194). Additionally, spacers 234 (FIG. 9 and 12) maintain the appropriate distance between lower links 194 and cranks 208 to prevent interference or friction therebetween or from side frames 86. By minimizing friction between the movable components (e.g., upper links 174 vis a vis cradles 106, upper links 174 vis a vis lower links 194 and springs 96, and lower links 194 and cranks 208 vis a vis each other and side framed 86), the time to transfer the forces via operating mechanism 38 decreases.

Raised portions 189 and 192, sidewalls 197 of bearing washers 196, and spacers 234 are also suitable to widen the base of operating mechanism 38. This is particularly useful, for example, in an asymmetrical system, where the operating mechanism is disposed on one cassette in a four-pole system.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A multiple pole circuit breaker comprising:

a plurality of separable contact structures;

a mechanism in operable communication with one of said separable contact structures and interfacing said separable contact structures for controlling and tripping thereof, said mechanism comprising:

a frame;

a drive member pivotally coupled to said frame;

a spring pivotally connecting said drive member to a drive connector;

an upper link member pivotally seated against said drive connector;

a lower link member pivotally coupled to said drive connector;

a crank member pivotally coupled to said lower link member and pivotally coupled to said frame, said crank member for interfacing said separable contact structure; and a cradle member pivotally secured to said frame, said cradle member pivotally securing said upper link member, said cradle member being configured for being releasably engaged by a latch assembly, said latch assembly configured for being displaced upon occurrence of a predetermined condition in the circuit;

wherein said mechanism is movable between a tripped position, a reset position, an off position, and an on position, wherein said separable contact structures are movable between a first and second position, said first position allowing current to flow through said circuit and said second position prohibiting current from flowing through said circuit, further wherein:

said mechanism tripped condition is achieved upon occurrence of said predetermined condition causing said latch assembly to release said cradle member, said cradle member pivoting relative to said frame, thereby causing said upper link member to pivot on said portion of said cradle member, said motion of upper link transferring motion via said drive connector to said lower link member and said spring causing said spring to discharge and cause lower link member to urge said separable contact structure from its first position to its second position;

said mechanism reset position is achieved upon application of a reset force to cause said cradle member to pivot relative to said frame and urge said latch assembly until said cradle member and said latch assembly are aligned;

said mechanism off position is achieved upon eliminating said reset force such that said latch assembly is releasably engaged with said cradle member, said separable contact structure being in its second position; and said mechanism on position is achieved upon application of a closing force so that force is transmitted through said drive member to said spring, said spring transmitting force via said drive connector to said upper link member causing said upper link member to pivot relative to said cradle member and to said lower link member causing said crank member to pivot relative to said frame causing said separable contact structure to move from its second position to its first position.

2. The multiple pole circuit breaker as in claim 1, said separable contact structure upon which said mechanism is attached relative to is mounted for rotation within an enclosure, said enclosure having at least one wall, said wall having an outside surface, said frame having an inside surface opposing said wall outside surface, said wall outside surface comprising a protrusion to set a distance between said wall outside surface and said frame inside surface.

3. The multiple pole circuit breaker as in claim 2, said lower link member disposed between said frame inside surface and said wall outside surface.

4. The multiple pole circuit breaker as in claim 3, said distance between said wall outside surface and said frame inside surface being dimensioned to minimize friction between said lower link member and said wall outside surface or said frame inside surface.

5. The multiple pole circuit breaker as in claim 3, said wall outside surface comprising a plurality of protrusions to set a distance between said wall outside surface and said frame inside surface.

6. The multiple pole circuit breaker as in claim 5, said lower link member disposed between said frame inside surface and said wall outside surface.

7. The multiple pole circuit breaker as in claim 6, said distance between said wall outside surface and said frame inside surface being dimensioned to minimize friction between said lower link member and said wall outside surface or said frame inside surface.

8. A multiple pole circuit breaker comprising:

a plurality of separable contact structures;

a mechanism in operable communication with one of said separable contact structures and interfacing said separable contact structures for controlling and tripping thereof, said mechanism comprising:

a frame;

a drive member pivotally coupled to said frame;

a spring pivotally connecting said drive member to a drive connector;

an upper link member pivotally seated against said drive connector;

a lower link member pivotally coupled to said drive connector;

a crank member pivotally coupled to said lower link member and pivotally coupled to said frame, said crank member for interfacing said separable contact structure; and a cradle member pivotally secured to said frame, said cradle member pivotally securing said upper link member, said cradle member being configured for being releasably engaged by a latch assembly, said latch assembly configured for being displaced upon occurrence of a predetermined condition in the circuit;

wherein said mechanism is movable between a tripped position, a reset position, an off position, and an on position, wherein said upper link member including a first and second opening, said cradle member including an opening and a slot, wherein said upper link member and said cradle member are positioned such that said first opening of said upper link member and said opening in said cradle member are aligned, and such that said second opening of said upper link member and said slot in said cradle member are aligned, further wherein a first securement structure couples said upper link member and said cradle by being disposed through said first opening of said upper link member, through said opening in said cradle member, and into a connecting structure, and a second securement structure couples said upper link member and said cradle by being disposed through said second opening of said upper link member, through said slot in said cradle member, and into said connecting structure.

9. The multiple pole circuit breaker as in claim 8, further wherein said first and second securement structures each comprise a raised portion between said upper link member and said cradle member.

10. The multiple pole circuit breaker as in claim 9, further wherein said raised portions are dimensioned for minimizing friction between said upper link member and said cradle member.

11. The multiple pole circuit breaker as in claim 9, further wherein said raised portions spread said upper link member and said cradle member apart so that when a force is applied to either said upper link member or said cradle member, said force is distributed over a wider base.

12. The multiple pole circuit breaker as in claim 1, further wherein said lower link member is pivotally coupled to said crank member with a pivotal rivet.

13. The multiple pole circuit breaker as in claim 12, further wherein a spacer is positioned in said pivotal rivet between said lower link member and said crank member.

14. The multiple pole circuit breaker as in claim 13, said frame having an inside surface and an outside surface, wherein said spacer is dimensioned to position said lower link member proximate to said inside surface of said frame and to position said crank member proximate to said outside surface of said frame.

15. The multiple pole circuit breaker as in claim 14, further wherein said spacer is dimensioned for minimizing friction between said lower link member and said crank member.

16. The multiple pole circuit breaker as in claim 14, further wherein said spacer is dimensioned for minimizing friction between said lower link member and said inside surface of said frame.

17. The multiple pole circuit breaker as in claim 14, further wherein said spacer is dimensioned for minimizing friction between said crank member and said outside surface of said frame.

18. The multiple pole circuit breaker as in claim 14, further wherein said spacer spreads said lower link member and said crank member apart so that when a force is applied to either said lower link member or said crank member, said force is distributed over a wider base.

19. The multiple pole circuit breaker as in claim 1, further wherein said drive connector includes a bearing portion, said upper link member seated against said bearing portion.

20. The multiple pole circuit breaker as in claim 19, said lower link member being coupled proximate to a first side of said bearing portion and said spring coupled proximate to a second side of said bearing portion, said second side being opposite said first side.

21. A multiple pole circuit breaker comprising:

a plurality of separable contact structures;

a mechanism in operable communication with one of said separable contact structures and interfacing said separable contact structures for controlling and tripping thereof, said mechanism comprising:

a frame;

a drive member pivotally coupled to said frame;

a spring pivotally connecting said drive member to a drive connector;

an upper link member pivotally seated against said drive connector;

a lower link member pivotally coupled to said drive connector;

a crank member pivotally coupled to said lower link member and pivotally coupled to said frame, said crank member for interfacing said separable contact structure; and a cradle member pivotally secured to said frame, said cradle member pivotally securing said upper link member, said cradle member being configured for being releasably engaged by a latch assembly, said latch assembly configured for being displaced upon occurrence of a predetermined condition in the circuit;

wherein said mechanism is movable between a tripped position, a reset position, an off position, and an on position, wherein said drive connector includes a bearing portion, said upper link member seated against said bearing portion, wherein said lower link member being coupled proximate to a first side of said bearing portion and said spring coupled proximate to a second side of said bearing portion, said second side being opposite said first side, wherein said bearing portion including an upstanding portion on said first side.

22. The multiple pole circuit breaker as in claim 21, wherein said upstanding portion is dimensioned for minimizing friction between said lower link member and said upper link member.

23. The multiple pole circuit breaker as in claim 21, wherein said upstanding portion spreads said spring, said lower link member and said upper link member apart so that when a force is applied to either said spring, said lower link member or said upper link member, said force is distributed over a wider base.

24. The multiple pole circuit breaker as in claim 20, said bearing portion including an upstanding portion on said second side.

25. The multiple pole circuit breaker as in claim 24, wherein said upstanding portion is dimensioned for minimizing friction between said spring and said upper link member.

26. The multiple pole circuit breaker as in claim 24, wherein said upstanding portion spreads said spring, said lower link member and said upper link member apart so that when a force is applied to either said spring, said lower link member or said upper link member, said force is distributed over a wider base.

27. The multiple pole circuit breaker as in claim 24, wherein said upstanding portion is dimensioned for preventing said upper link member from interfering with said spring.

28. The multiple pole circuit breaker as in claim 20, said bearing portion including a first upstanding portion on said first side and a second upstanding portion on said second side.

29. The multiple pole circuit breaker as in claim 28, wherein said first and second upstanding portions is dimensioned for minimizing friction between said spring and said upper link member.

30. The multiple pole circuit breaker as in claim 28, wherein said first and second upstanding portions spreads said spring, said lower link member and said upper link member apart so that when a force is applied to either said spring, said lower link member or said upper link member, said force is distributed over a wider base.

31. The multiple pole circuit breaker as in claim 28, wherein said first and second upstanding portions are dimensioned for preventing said upper link member from interfering with said spring.

32. The multiple pole circuit breaker as in claim 2, wherein:

said upper link member includes a first and second opening, said cradle member including an opening and a slot, wherein said upper link member and said cradle member are positioned such that said first opening of said upper link member and said opening in said cradle member are aligned, and such that said second opening of said upper link member and said slot in said cradle member are aligned, further wherein a first securement structure couples said upper link member and said cradle by being disposed through said first opening of said upper link member, through said opening in said cradle member, and into a connecting structure, and a second securement structure couples said upper link member and said cradle by being disposed through said second opening of said upper link member, through said slot in said cradle member, and into said connecting structure, said first and second securement structures each comprising a raised portion between said upper link member and said cradle member;

said lower link member being pivotally coupled to said crank member with a pivotal rivet, wherein a spacer is positioned in said pivotal rivet between said lower link member and said crank member; and said drive connector including a bearing portion, said upper link member seated against said bearing portion, said lower link member being coupled proximate to a first side of said bearing portion and said spring coupled proximate to a second side of said bearing portion, said second side being opposite said first side, said bearing portion including a first upstanding portion on said first side and a second upstanding portion on said second side.

33. A multiple pole circuit breaker comprising:

a plurality of separable contact structures;

a mechanism in operable communication with one of said separable contact structures and interfacing said separable contact structures for controlling and tripping thereof, said mechanism comprising:

a pair of frames, said frames each having an inside surface and an outside surface, said inside surfaces arranged opposing a pair of opposite sides of said separable contact structure having said mechanism attached relative thereto;

a drive member pivotally coupled to said frames;

a pair of springs pivotally connecting said drive member to a drive connector, said springs and said drive connector arranged between said frames;

a pair of upper link member pivotally seated against said drive connector, each of said upper link members arranged between each of said springs and said frames;

a pair of lower link member pivotally coupled to said drive connector, each of said lower link members arranged between each of said upper link member and said frames;

a pair of crank members pivotally coupled to said lower link members and pivotally coupled to said frames relative to said outside surfaces of said frames, said crank members for interfacing said separable contact structures; and a pair of cradle members pivotally secured to said frames relative to said inside surfaces of said frames, said cradle members each arranged between each of said frames and said upper link members, each of said cradle members pivotally securing each of said upper link member, said cradle members being configured for being releasably engaged by a latch assembly, said latch assembly configured for being displaced upon occurrence of a predetermined condition in the circuit;

wherein said mechanism is movable between a tripped position, a reset position, an off position, and an on position, wherein said separable contact structures are movable between a first and second position, said first position allowing current to flow through said circuit and said second position prohibiting current from flowing through said circuit, further wherein:

said mechanism tripped condition is achieved upon occurrence of said predetermined condition causing said latch assembly to release said cradle members, said cradle members pivoting relative to said frames, thereby causing said upper link members to pivot relative to said cradle member, said motion of said upper link members transferring motion via said drive connector to said lower link members and said springs causing said springs to discharge and cause lower link members to transfer motion to said crank members, and causing said crank members to urge said separable contact structures from their first position to their second position;

said mechanism reset position is achieved upon application of a reset force to cause said cradle members to pivot relative to said frame and urge said latch assembly until said cradle members and said latch assembly are aligned;

said mechanism off position is achieved upon eliminating said reset force such that said latch assembly is releasably engaged with said cradle members, said separable contact structures being in their second position; and said mechanism on position is achieved upon application of a closing force so that force is transmitted through said drive member to said springs, said springs transmitting force via said drive connector to said upper link members causing said upper link members to pivot relative to said cradle members and to said lower link members causing said crank members to pivot relative to said frames causing said separable contact structures to move from their second position to their first position.

34. The multiple pole circuit breaker as in claim 33, said separable contact structure having said mechanism secured thereto mounted for rotation within an enclosure, said enclosure having at least a pair of walls, said walls having outside surfaces, said inside surfaces of said frames opposing said outside surfaces of said walls, said outside surfaces of said walls comprising a protrusion to set a distance between said outside surfaces of said walls and said inside surfaces of said frames.

35. The multiple pole circuit breaker as in claim 34, said lower link members disposed between said inside surfaces of said frames and said outside surfaces of said walls.

36. The multiple pole circuit breaker as in claim 35, said distance between said outside surfaces of said walls and said inside surfaces of said frames being dimensioned to minimize friction between said lower link members and outside surfaces of said walls or said inside surface of said frames.

37. The multiple pole circuit breaker as in claim 34, wherein said distance spreads said frames apart so that when a force is applied originating either from said drive member or from said cradle members, said force is distributed over a wider base.

* * * * *